United States Patent [19]

Ott et al.

[11] Patent Number: 4,675,644

[45] Date of Patent: Jun. 23, 1987

[54] VOLTAGE-DEPENDENT RESISTOR

[75] Inventors: Guenter Ott, Schwanberg; Franz Zettl, Deutschlandsberg, both of Austria

[73] Assignee: Siemens Aktiengesellschaft, Berlin and Munich, Fed. Rep. of Germany

[21] Appl. No.: 817,864

[22] Filed: Jan. 13, 1986

[30] Foreign Application Priority Data

Jan. 17, 1985 [DE] Fed. Rep. of Germany ..... 3501419

[51] Int. Cl.[4] ..... H01C 7/10

[52] U.S. Cl. ..... 338/21

[58] Field of Search ..... 338/21, 20; 264/66; 29/610 R, 25.42

[56] References Cited

U.S. PATENT DOCUMENTS 2,736,080 2/1956 Walker et al. ..... 264/66
3,235,939 2/1966 Rodriguez et al. ..... 29/25.42
4,290,041 9/1981 Utsumi et al. ..... 338/21

FOREIGN PATENT DOCUMENTS 1282119 11/1968 Fed. Rep. of Germany .
2523993 3/1982 France .

OTHER PUBLICATIONS

Properties of Multilayer ZnO Ceramic Varistors by N. Shohata, T. Matsumura, K. Utsumi & T. Ohno, American Ceramic Society, 1981, vol. 1, pp. 349–358.

Microstructure, Electrical Properties, & Failure Prediction in Low Clamping Voltage Zinc Oxide Varistors by L. Bowen & F. J. Avella, Journal of Applied Physics, No. 54, May 5, 1983, pp. 2764–2772.

Edelgasgefullte Uberspannungsableiter; Metalalloxid-Varistoren SIOV, Nov. 4, 1984, pp. 44–65, Siemens brochure.

*Primary Examiner*—Joseph W. Hartary
*Assistant Examiner*—M. M. Lateef
*Attorney, Agent, or Firm*—Hill, Van Santen, Steadman & Simpson

[57] ABSTRACT

A voltage-dependent resistor or varistor is composed of a monolithic ceramic body made up of a plurality of layers of varistor material containing zinc oxide, alternating with layers of precious metal serving as coatings on the layers and which are alternatingly electrically connected to separate locations on the exterior surfaces of the body. The porosity of the layers of varistor material does not exceed 5%; the proportion of bismuth is at most 1 mol %; and the precious metal coatings include 50–80% by weight of palladium.

7 Claims, 5 Drawing Figures

VOLTAGE-DEPENDENT RESISTOR

BACKGROUND

1. Field of the Invention

The present invention relates to a voltage-dependent resistor (varistor), and more particularly to such a unit composed of a ceramically manufactured, monolithic body, having a plurality of layers of varistor material.

2. Prior Art

Voltage-dependent resistors, or varistors which are manufactured with multi-layer technology are described in "Advances In Ceramics" (American Ceram. Society, 1981) Vol. 1, pp. 349–358. The average grain size is specified as 10 μm. The threshold voltage per grain boundary amounts to about 2–3 V. The specifications for the thickness of the varistor material layers are 20 μm through 200 μm, and properties are described which were measured with varistors having a layer thickness of 40 μm or 150 μm, composed of 20 layers stacked on top of each another. The non-linearity coefficient $\alpha$ is in the range of 20–30, and the varistor voltage, measured at one mA, is near the range of 4–40 volts.

Metal layers for contacting the coating are situated on the surface of the monolithic body and are formed of stoved silver. The publication referred to above does not provide details concerning the coatings within the interior of the monolithic body, nor the porosity of the material which is used.

The publication "Journal of Applied Physics", No. 54, May 5, 1983, pp. 2764–2772, describes low voltage varistors. In a reference to the American Ceramic Society publication referred to above, it describes that varistors made with multi-layer technology exhibit reduced current density at over-voltages, high capacitance without a resolution of the fundamental problem of the grain size distribution.

The Siemens brochure "Edelgasgefullte Uberspannungsableiter; Metalloxid-Varistoren SIOV", Nov. 4, 1984, pp. 44–63, describes the theoretical bases of metal oxide varistors using zinc oxide, and gives standard definitions of the applicable terms. Thus, the non-linearity coefficient $\alpha$ is specified on page 48 of the Siemens brochure as $$\alpha = \frac{\log I_2 - \log I_1}{\log U_2 - \log U_1}$$

in which $I_2$ is one ampere, $I_1 = 1$ mA, $U_2$ is the voltage measured at 1 A, and $U_1$ is the voltage measured at 1 mA. The voltage that is measured at 1 mA is defined as the "varistor voltage", and is used for the classification of varistors.

Low voltage varistors which are manufactured according to standard technology have grain sizes of about 10 μm and larger, in order to keep the number of grain boundaries between the coatings low. The use of such a coarse material, however, leads to the problem that the grain size distribution scatters greatly and thus the steepness of the voltage-current characteristic (the non-linearity coefficient $\alpha$) drops greatly. Low-voltage varistors manufactured in this way are usually not suitable for protection against higher voltages because the units cannot dissipate the heat adequately which arises in the ceramic body.

SUMMARY OF THE PRESENT INVENTION

A principal object of the present invention is to improve the characteristics of a voltage-dependent resistor (varistor) so that the range of the varistor voltage is expanded, and varistors having different varistor voltages can be manufactured from the same material.

Another object of the present invention is to provide an apparatus and method for reducing the quantity of palladium which is required for such components.

A further object of the present invention is to provide an improved voltage-dependent resistor having improved heat dissipation characteristics.

The objects of the present invention are achieved by employing a voltage-dependent resistor in which the porosity of the varistor material of the ceramic body does not exceed 5%, the proportion of bismuth (viz., $Bi_2O_3$) in the varistor material is in the range of 0.4–1 mol % (corresponding to a range of 2%–5% by weight); and the coatings are composed of silver. (50%–80% by weight), and palladium (50%–20% by weight).

Preferably, the porosity is less than 1%, with the result that the metal of the internal electrodes can not penetrate into pores which would lead to a shortened electrode path and a premature arc-over or short-circuit under application of a pulse voltage. The reduction of the bismuth proportion from the normal value in excess of 2 mol % to at most 1 mol %, and preferably 0.6 mol %, brings about the desirable result of reducing grain growth so that the grain size distribution is rendered more uniform and also of avoiding a reaction of the coatings with the ceramic material at the sintering temperature. In this way, the alloying-out or migration of the palladium (with the undesirable result of island formation) of the coatings is avoided. Preferably, the coatings are composed of 70% silver and palladium by weight.

It is advantageous to employ a ceramic body which is composed of a plurality of layers of varistor material with a thickness in the range of 35 μm through 350 μm. The thicker layers yield higher varistor voltages in the range between 4 volts and 350 volts.

The varistor body is preferably in the range of 1–10 mm long, in the range of 1–3.6 mm wide, and in the range of 0.5–3 mm thick. The thickness is always lower than the smaller of the length or width.

The preferred composition of the varistor material (with specifications in mol %, and the amount by weight in parenthesis),

| | | | |
|---|---|---|---|
| ZnO | 94.6 (87.3) | $Bi_2O_3$ | 0.6 (3.2) |
| $Sb_2O_3$ | 1.6 (5.1) | $Co_3O_4$ | 0.4 (1.1) |
| NiO | 1.3 (1.1) | $Cr_2O_3$ | 0.6 (1.1) |
| $MnCo_3$ | 0.8 (1.02) | MgO | 0.06 (0.003) |
| $B_2O_3$ | 0.033 (0.05) | $Al_2O_3$ | 0.002 (0.017) |
| $BaCo_3$ | 0.005 (0.001) | | |

The lower bismuth proportion enables sintering temperatures up to 1,150° C., allowing the manufacture of varistors having a varistor voltage down to 4 V with a plurality of thin layers.

The steps used in the process of manufacture of these multi-layer varistors employs the steps which are known in connection with ceramic multi-layer capacitors, described in U.S. Pat. Nos. 2,736,080 and 3,235,939, and in German Patent No. 1 282 119, for example.

With the assistance of organic binder materials, for example polymethylacrylates, methylcelluloses, polyvinylalcohol, and solvents such as water and ethylmethyl ketone, as well as softeners such as phthalates and esthers, a slip is produced of the initial material having a mean grain size of about 1 μm as a result of fine grinding. This slip is then drawn into a thin film by means of standard technologies such as calendaring, the use of stripper techiques, or the use of a doctor blade. A pattern of the internal coatings of the specified silver-palladium compound is applied to the films, over areas corresponding roughly to the size of a postcard, with the postcard-size films being stacked on top of one another, with alternating offset of the coatings. Finally, after a pressing operation, the varistor is separated from the stack in raw form, passed through a tempering and binder expulsion cycle (which is standard in multi-layer technology), and is then is sintered at temperatures up to 1150° C. As noted above, this method is known in general, and variations in the specific steps of the method are also known.

BRIEF DESCRIPTION OF THE DRAWINGS

Reference will now be made to the accompanying drawings in which:

Referring now to FIG. 1, a varistor body 1 is shown which is composed of a plurality of layers 2 of varistor material. The coatings 3 and 4 alternate with the layers 2 of varistor material, with the coatings 3 being brought out to the right-hand exterior surface 5, and the coatings 4 are brought out to the left-hand exterior surface 6 of the ceramic body. As a result of the sintering process, the ceramic body is composed of a monolithic block, having the coatings 3 and 4 situated within its interior. It is also possible to have the coatings 3 and 4 brought out to the same side of the monolithic block, in which the the ends to be contacted then terminate alternately at different locations. These ends are then contacted separately so as to maintain polarity.

The coatings 3 are all electrically connected to each other at the surface 5, to from one pole, and the coatings 4 are all connected to each other at the other surface 6 to form another pole. The connection scheme may be referred to as antipolar. In the present case, antipolar means that the coatings 3 at the surface 5 are connected to a further metal layer 7 formed for example of silver or some other solderable metal, which is adapted to be connected to one pole of the voltage source or circuit, while the coatings 4 are electrically connected to each other at the surface side 6 by a further metal layer 8, formed of silver or the like, which is adapted to be connected to the opposite pole of the voltage source or circuit. The reference numeral 9 refers to the thickness of the layers 2 of the varistor material. The composite body illustrated in FIG. 1 has an upper layer 10, above the uppermost coating 3, and lower layer 11, below the lowermost coating 4. The thickness of the layers 10 and 11 must be greater than the thickness of the layers 2. In order to achieve this thickness, varistor material layers 2' which do not contain any coatings 3 or 4 are provided. As shown in FIG. 1, the boundary lines 16 and 17 within the layers 2' have no coating. In addition, the spacings 12 and 13 between the coatings 3 and 4 and the metal layers 7 and 8 are also greater than the thickness 9.

Current leads 18 and 19 are connected to the metal layers 7 and 8, so as to furnish a convenient way of connecting the varistor to an electrical circuit. The current leads may be soldered or otherwise fixed to the metal layers 7 and 8.

Figure 1:
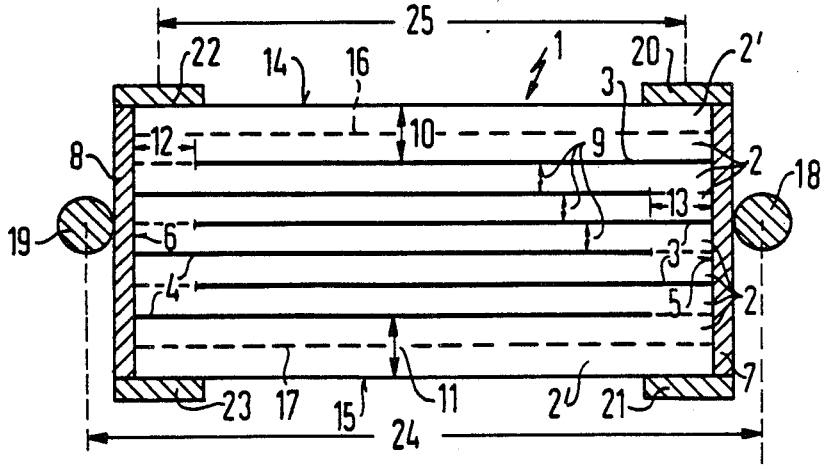
FIG. 1 is a schematic diagram of a multi-layer varistor.

When the varistor of the present invention is to be employed in the form of a chip, contact pads can be provided instead of the current leads, such contact pads being shown in FIG. 1 by the extensions 20 and 21 of the metal layer 7 which overlie the surfaces 14 and 15, as well as the extensions 22 and 23 of the metal layer 8 which overlie the surfaces 14 and 15.

When it is desired to employ the varistor in printed circuits having contact locations which are situated in a grid dimension (with multiples of 2.5 mm), the dimension 24 between the current leads 18 and 19 is defined to conform to this spacing. On the other hand, a different grid dimension spacing may be used (such as spacing 25 in FIG. 1), between the upper contact pads 20 and 22.

In the arrangement of FIG. 1, the coatings 3 and 4 have a thickness in the range which is equal or less than 5 μm, and is preferably 2 μm. This gives a good dissipation of the heat generated within the interior of the monolithic block, since relatively more silver than palladium is employed, and because these layers can be formed thicker than is possible to make pure palladium layers. In addition, the required amount of relatively costly palladium is reduced.

Figure 2:
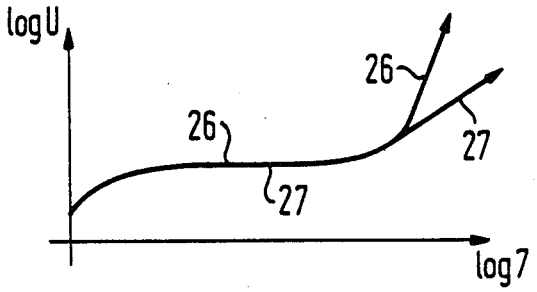
FIG. 2 is a voltage-current diagram which shows the improvement achieved by the present invention.

The voltage-current diagram shown in FIG. 2 shows that one of the advantages of the present invention (resulting from the low amount of bismuth in the varistor material, and the employment of the composition of silver and palladium which makes thicker coatings possible) is that the undesirable alloying-out or migration of the metal of the coatings does not occur, thus avoiding the undesirable island formation which deteriorates the properties of the varistor. The voltage-current diagram of FIG. 2 illustrates this. With traditional varistors, the curve 26 rises suddenly and steeply when the current intensity reaches its upper range, whereby the curve 27 for the varistors formed in accordance with the present invention show a considerably reduced rise in the upper current ranges.

The island formation arises due to the out-alloying (or migration) of coatings produces a pronounced rise of the clamping voltage at higher currents because the intermediate resistance of the coatings rises greatly as a consequence of this this island formation.

Figure 3:
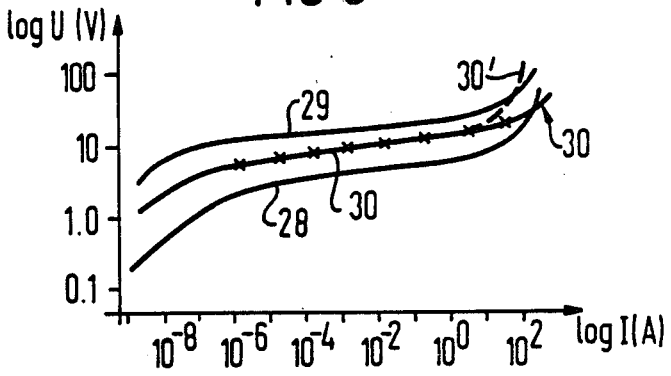
FIG. 3 is a voltage-current diagram illustrating a comparison between the varistor of the present invention and the prior art.

Referring to FIG. 3, a voltage-current diagram is illustrated in which a varistor of the present invention is shown in curve 30, compared to curves of known varistors (in curves 28 and 29). The scale and curve progression shown in FIG. 3 are taken from FIG. 2 of the "Advances in Ceramics" publication referred to above.

The curve 28 applies to varistors which are composed of 20 layers of varistor material each having a thickness of 4 μm, whereas the curve 29 applies to a varistor having 20 layers of varistor material each having a thickness of 150 μm. The curve 30 applies to varistors constructed in accordance with the present invention having 50 layers of varistor material each with a thickness of 30 μm.

FIG. 3 illustrates that the known varistors produce a greatly rising clamping voltage, which maybe up to 100 volts, at 10 amperes, while such a rise does not take place with the curve 30 of the present invention. The dashed line 30' illustrates the characteristic which would result with a varistor of the specified layers and thicknesses, if the present invention were not used.

The use of 50 layers in the varistor significantly increases the stability of the varistor, the dissipation of heat out of the ceramic body is adaquate with coatings of 70% silver and 30% palladium, such coatings having a thickness 2.0 μm. This guarantees the operability of the varistor even at high currents or at high voltages.

Figure 4:
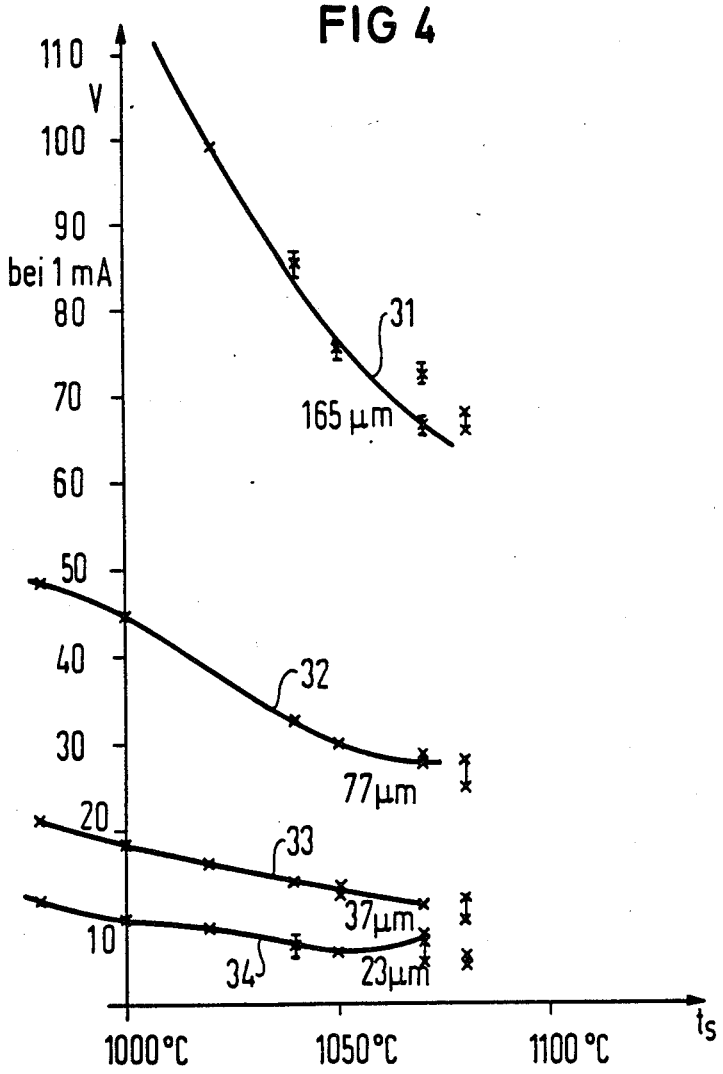
FIG. 4 is a diagram illustrating the dependency of the varistor voltage on the sintering temperature.

FIG. 4 shows that the varistor voltage is dependent on the sintering temperature, given a sintering time of one hour for varistors which are composed of 10 layers. FIG. 4 illustrates the effect on varistor structures having different layer thicknesses. The varistor voltage is indicated in volts on the ordinate, and the sintering temperature $t_s$ is indicated in degrees C. on the abscissa. The varistor for which the curves of FIG. 4 apply have coatings composed of 70% silver and 30% palladium, with a thickness 2 μm.

The curve 31 describes the characteristic for varistors of 10 layers having a layer thickness of 165 μm each. The curve 32 describes varistors of 10 layers having a layer thickness of 77 μm each. The curve 33 describes varistors of 10 layers having a thickness of 37 μm each and the curve 34 describes varistors of 10 layers having a layer thickness of 23 μm each. FIG. 4 indicates that a relatively decreasing varistor voltages may be achieved with decreasing layer thickness, and also with increasing sintering temperature.

When a relatively high sintering temperature up to 1080° C. is used, a very high density or low porosity of the layers of ceramic material is achieved, so that the electrical properties of the varistors are significantly improved. The increased sintering temperature is made possible as a result of the low bismuth component.

Figure 5:
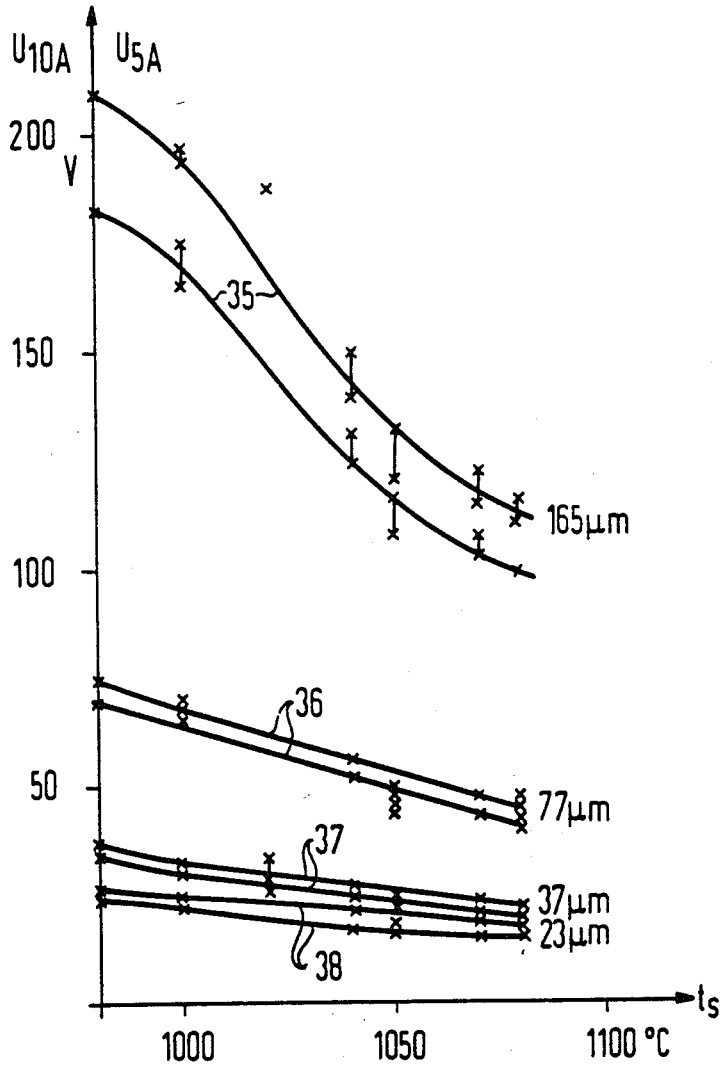
FIG. 5 is a diagram illustrating the dependency of the level of the protection voltage on the sintering temperature.

FIG. 5 illustrates curves which show that the level of protection is dependent on the sintering temperature. The protection level is the clamping voltage appearing at a varistor, given a current pulse having a current of 10 A or 1 A. The clamping voltage V is shown at the ordinate of FIG. 5, whereas the sintering temperature $t_s$ is shown in degrees C. on the abscissa.

Four curve pairs 35–38 are shown, for layer thicknesses in their sintered condition of respectively 165, 77, 37, and 23 μm. The upper curve of the curve pair is for a current of 10 A and the lower curve is valid for a current of 5 A.

It is also apparent from the diagram of FIG. 5 that decreasing values of clamping voltage are achieved with decreasing layer thickness, and increasing sintering temperature.

A varistor constructed in accordance with the present invention guarantees a dielectric strength of 300 V/mm, whereas adequate non-linearity exponent $\alpha$ is also guaranteed, due to the thin layers of the varistor material.

The present invention avoids the disadvantages which result from the use of coarse-crystaline material having a dielectric strength below 150 V/mm. These problems arise as a consequence of too few grains, and a scattering in grain size, as explained in the "Journal of Applied Physics" publication referred to above. These disadvantages are voided by use of the presnet invention.

It will be apparent that in the foregoing, an improved voltage-dependent resistor or varistor is described in such detail as to enable others skilled in the art to make and use the same. It will apparent that various modifications and additions may be made without departing from the essential features of novelty thereof, which are intended to be defined and secured by the appended claims.

What is claimed is:

1. A voltage-dependent resistor having a ceramic monolithic body composed of a plurality of layers of varistor material having a thickness in the range of 20 μm to 350 μm, said varistor material having grain sizes from 7 μm to 22 μm and being composed of zinc oxide together with up to 6 mol % additives of one or more of oxides in the group of metals Bi, Sb, Co, Ni, Cr, Mn, Mg, B, Al, and Ba, and having layers of precious metals serving as coatings with a thickness in the range equal to or less than 10 μm, said coatings alternating with the layers of varistor material and alternatingly conducted to different locations on the external surfaces of said body and electrically connected together in antipolar fashion, the porosity of said layers of varistor material being equal to or less than 5%, the proportion of bismuth (calculated as $Bi_2O_3$) in said varistor material is in the ranges 0.4–1 mol % or 2–5% by weight, and said coatings being composed of 50–80% by weight of silver and 50–20% by weight of palladium.

2. The voltage-dependent resistor according to claim 1, wherein the porosity of said layers of varistor material is equal to or less than 1%.

3. The voltage-dependent resistor according to claim 1 or claim 2, in which said bismuth proportion is about 0.6 mol % or 3.2% by weight of $Bi_2O_3$.

4. The voltage-dependent resistor according to claim 1, wherein said coatings are composed of 70% silver by weight 30% palladium by weight.

5. The voltage-dependent resistor according to claim 1, wherein the ceramic body is composed of a plurality of layers of varistor material having a thickness in the range of 20 μm to 350 μm, whereby thicker layers yield higher varistor voltages in the range of 4–350 volts.

6. The voltage-dependent resistor according to claim 1, wherein said varistor body has a length in the range of 1–10 mm, a width of 1–3.6 mm, and thickness of 0.5–3 mm, with said thickness being less than the lower of said length and width.

7. The voltage-dependent resistor according to claim 1, wherein said varistor material comprises, with the proportions expressed in mol % (and expressed in % by weight in parentheses): ZnO 94.6 (87.3); $Bi_2O_3$ 0.6 (3.2); $Sb_2O_3$ 1.6 (5.1); $Co_3O_4$ 0.4 (1.1); NiO 1.3 (1.1); $Cr_2O_3$ 0.6 (1.1); $MnCO_3$ 0.8 (1.02); MgO 0.06 (0.003); $B_2O_3$ 0.033 (0.05); $Al_2O_3$ 0.002 (0.017); and $BaCO_3$ 0.005 (0.001).

* * * * *